US005168027A

United States Patent [19]

Taguchi et al.

[11] Patent Number: 5,168,027

[45] Date of Patent: Dec. 1, 1992

[54] CARRIER OF DEVELOPER, PROCESS FOR PREPARATION THEREOF, AND DEVELOPING METHOD USING SAME

[75] Inventors: Kyouya Taguchi, Nishinomiya; Takashi Teshima, Ibaragi; Kazuhiko Yamamura, Higashi-osaka; Takatomo Fukumoto, Osaka, all of Japan

[73] Assignee: Mita Industrial Co., Ltd., Osaka, Japan

[21] Appl. No.: 599,826

[22] Filed: Oct. 19, 1990

[30] Foreign Application Priority Data

Oct. 19, 1989 [JP] Japan ..... 1-270357

[51] Int. Cl.[5] ..... G03G 9/10

[52] U.S. Cl. ..... 430/108

[58] Field of Search ..... 430/108, 120, 137

[56] References Cited

U.S. PATENT DOCUMENTS 4,430,410 2/1984 Aizawa et al. ..... 430/120
4,971,880 11/1990 Hotomi et al. ..... 430/108
5,015,550 5/1991 Creatura et al. ..... 430/108

*Primary Examiner*—John Goodrow
*Attorney, Agent, or Firm*—Sherman and Shalloway

[57] ABSTRACT

Disclosed is a carrier of a developer, which is characterized in that the current value observed when a direct current is applied under a voltage of 200 V is 0.8 to 2.0 μA and the relaxation time is in the range of from 4.0 to 6.0 milliseconds, that is, the characteristic values in the dynamic state, for example, in a developing apparatus, are kept with certain ranges. If this developer carrier is used, an image having a high quality can be obtained without occurrence of troubles often caused in conventional developers, such as carrier dragging (transfer of the carrier to a photosensitive material together with the toner), fogging (transfer of the toner to the background of a copying sheet) and letter thinning.

4 Claims, 3 Drawing Sheets

CARRIER OF DEVELOPER, PROCESS FOR PREPARATION THEREOF, AND DEVELOPING METHOD USING SAME

BACKGROUND OF THE INVENTION (1) Field of the Invention

The present invention relates to a carrier of a developer. More particularly, the present invention relates to a carrier of a developer capable of preventing so-called carrier dragging and providing an image having an excellent quality without occurrence of such troubles as fogging, letter thinning and rear end blurring at the developing step and a process for the preparation thereof.

Furthermore, the present invention relates to a developing process in which a two-component type developer comprising this carrier is advantageously used.

Incidentally, by the term "carrier dragging" is meant an undesirable phenomenon that in a two-component type developer, a carrier is transferred to a photosensitive material together with a toner and development is carried out in this state. By the term "fogging" is meant the phenomenon of transfer of a toner and the like to a background portion of a copying sheet. Furthermore, by the term "letter thinning" is meant a phenomenon that a letter or line is thinly developed, and by the term "rear end blurring" is meant blurring of the rear end of an image area on a copying sheet.

(2) Description of the Related Art

A two-component type developer comprising a magnetic carrier and a toner is widely used in the field of commercial electrophotosensitive material, and at the development of a charged image, a magnetic brush of this developer is formed on a developing sleeve having magnetic poles disposed in the interior thereof, and this magnetic brush is brought into sliding contact with a photosensitive material having the charged image formed thereon to form a toner image.

It is known that a ferrite carrier can be used as the magnetic carrier. For example, Japanese Unexamined Patent Publication No. 60-170863 teaches that a ferrite carrier having a resistivity lower than $5\times10^7\Omega$-cm and a particle size of 50 to 120 $\mu$m is used as the magnetic carrier of the two-component type developer, and that by using this magnetic carrier, the density of a solid black portion can be uniformalized without reduction of the resolving power.

However, although this known developer is capable of increasing the image density of a solid image portion, in the reproduction of multiple fine lines, the line width is not constant among the respective lines and lacking of the top end or rear end is caused, and the general image quality is still unsatisfactory.

The characteristics of heretofore proposed magnetic carriers are defined by static conditions such as resistivity, particle size, shape and dielectric constant, and selection of a magnetic carrier or adjustment of the amount of a coating resin based on such static conditions is not defined by factors under dynamic conditions in an actual copying machine. Namely, the characteristics in the state of dynamic constant between the magnetic brush of the developer on the developing sleeve and the surface of the photosensitive material are not defined. Accordingly, sufficient correspondence of these characteristics to the actual developing conditions cannot be found.

In view of this circumstance, in the present invention, the amount of a resin coated on the carrier is determined based on the current value. However, if this characteristic alone is specified, though the above-mentioned carrier dragging or reduction of the image density is not caused, letter thinning or fogging is sometimes caused and this adjustment of the amount coated of the resin is still insufficient.

An organic photosensitive material which has a good processability and is advantageous in the manufacturing cost and has a large freedom of the design of functions is recently used as the photosensitive material for the electrophotography. The organic photosensitive material includes a negatively chargeable type and a positively chargeable type. Since the negatively chargeable type often induces contamination of the copying environment, use of the positively chargeable photosensitive material is now expected.

In this positively chargeable photosensitive material, however, the residual voltage is apt to become larger than in the conventional Se type photosensitive material, and therefore, in the case where the positively chargeable photosensitive material is used, the bias voltage should be maintained at a level higher than in the conventional technique. Elevation of the bias voltage increases the charge repulsion between the magnetic carrier and the developing sleeve. Accordingly, carrier dragging is often caused. Therefore, at the development of the positively chargeable photosensitive material, prevention of carrier dragging and improvement of the image density are required.

SUMMARY OF THE INVENTION

It is a primary object of the present invention to provide a carrier of a developer capable of forming an excellent image without carrier dragging, fogging, letter thinning and reduction of the image density, and a process for the preparation thereof.

Another object of the present invention is to provide a developing process in which the above-mentioned carrier can be advantageously used under appropriate conditions and especially, a positively chargeable organic photosensitive material frequently used at the present, is used as the photosensitive material.

More specifically, in accordance with one fundamental aspect of the present invention, there is provided a carrier of a developer, which is characterized in that the current value observed when a direct current is applied under a voltage of 200 V is 0.8 to 2.0 $\mu$A and the relaxation time is in the range of from 4.0 to 6.0 milliseconds.

The developer carrier of the present invention can comprise a carrier material and a resin coating formed thereon, wherein the carbon amount of the coating resin, as determined by a carbon analyzer, is 1.0 to 1.8% by weight based on the entire weight of the carrier. This carrier material can be composed of spherical ferrite particles.

In the developer carrier of the present invention, the above-mentioned ferrite carrier can have a particle size of from 20 to 200 $\mu$m.

In accordance with another aspect of the present invention, there is provided a process for the preparation of a developer carrier coated with a resin, which comprises coating the surface of a carrier material with a resin while adjusting the amount coated of the resin so that the current value observed when a direct current is applied under a voltage of 200 V is 0.8 to 2.0 $\mu$A and the relaxation time is in the range of from 4.0 to 6.0 milliseconds.

In accordance with still another aspect of the present invention, there is provided a developing process comprising carrying out the development while supplying a two-component type developer comprising a toner and a carrier, in which the current value observed when a direct current is applied under a voltage of 200 V is 0.8 to 2.0 μA and the relation time is in the range of from 4.0 to 6.0 milliseconds, to a developing mechanism to which a bias voltage of at least 250 V is applied.

In the developing process of the present invention, a positively chargeable organic photosensitive material can be used in the developing mechanism.

DETAILED DESCRIPTION OF THE PREFERRED EMBODIMENTS

The present invention is based on the finding that if a magnetic carrier in which the current value and relaxation time, which are dynamic conditions, are within specific ranges is used, an excellent developed image having a high density can be obtained without carrier dragging, fogging and letter thinning.

In the instant specification and appended claims, the current value is one observed when a direct current voltage of 200 V is applied in the state where the carrier forms a magnetic brush on the developing sleeve and this magnetic brush is moving.

Figure 1:
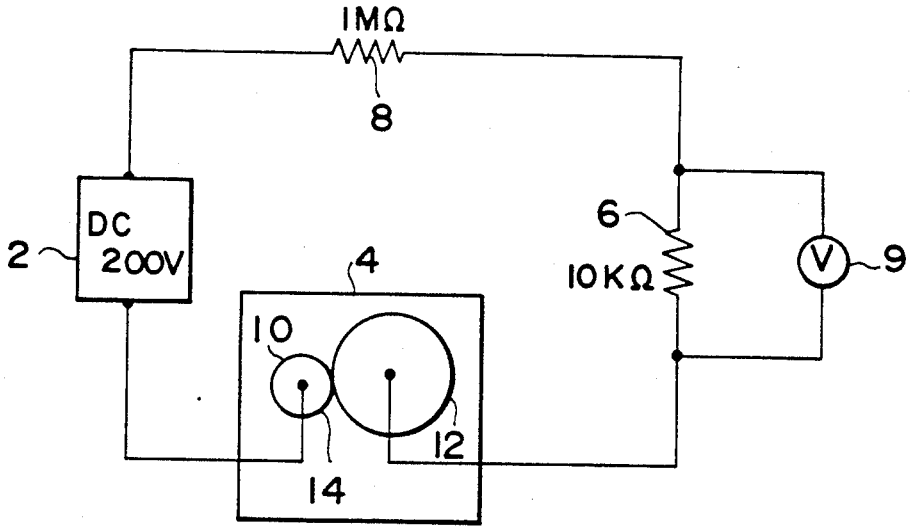
FIG. 1 is a diagram illustrating an apparatus for measuring the current value.

Referring to FIG. 1 illustrating the apparatus for measuring the current value, a direct current power source (200 V) 2 is connected in series to a developing box 4, a resistor 6 of 10 kΩ and a resistor 8 of 1 MΩ, and a voltage meter 9 is arranged in the resistor 6 of 10 kΩ. A magnet drum 10 assumed as the developing sleeve and a photosensitive material drum 12 are arranged in the developing box 4, and a magnetic carrier layer 14 is disposed between the two drums. The distance between the magnet drum 10 and the photosensitive material drum 12 is adjusted to 4.5 mm. In this structure, the magnet drum and photosensitive material drum are rotated, and the current value is determined by dividing the measured value of the voltage meter 9 by the resistance value of the resistor 6.

According to the present invention, if the carrier is selected so that the current value under dynamic conditions, determined by the above-mentioned method, is 0.8 to 2.0 μA, especially 1.1 to 1.5 μA, carrier dragging and reduction of the image density are hardly caused in the developer comprising this carrier. However, it sometimes happens that fogging or line thinning is caused or an image having a generally excellent quality is not obtained.

In the instant specification and appended claims, the relaxation time in the dynamic state is the relaxation time in the state where the carrier or developer forms a magnetic brush on the developing sleeve and this magnetic brush is being moved.

Figure 2:
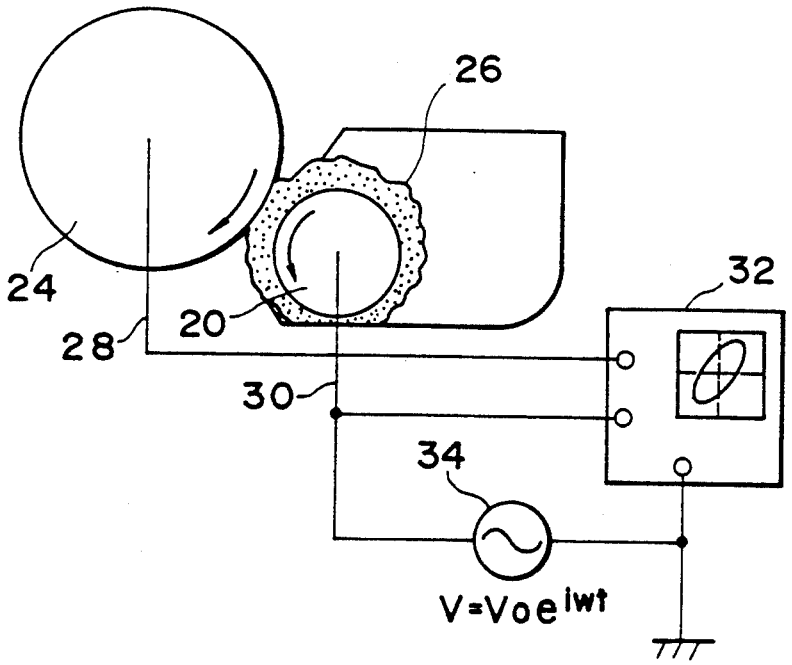
FIG. 2 is a diagram illustrating an apparatus for measuring the relaxation time.

Referring to FIG. 2 illustrating the apparatus for measuring the relaxation time, a carrier layer 26 comprising a magnetic carrier and a toner is interposed between a developing sleeve 20 having magnetic poles (not shown) disposed in the interior thereof and a conductor drum 24 having the same shape and size as those of a photosensitive drum. The developing sleeve 20 and the drum 24 are rotated so that they move in the same direction at the nip position (the rotation directions are reverse to each other). The developing sleeve 20 and drum 24 are connected to a measurement digital oscillograph 32 through connecting lines 28 and 30, respectively, and the sleeve 20 is further connected to a measurement alternating current power source 34. While the developing sleeve 20 and drum 24 are rotated, an alternating current voltage of 50 Hz is applied between them from the alternating current power source 34, and the voltage and current are measured by the oscillograph 32. The relaxation time ($\tau$) is determined from the phase difference between the voltage and current.

Figure 3:
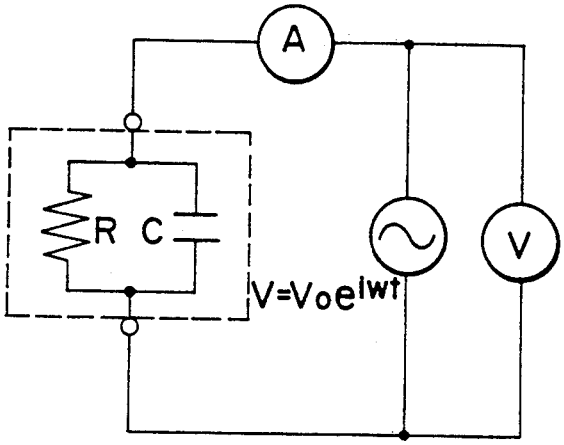
FIG. 3 is a diagram illustrating an electric circuit of the apparatus of FIG. 2 as the equivalent circuit.
Figure 4:
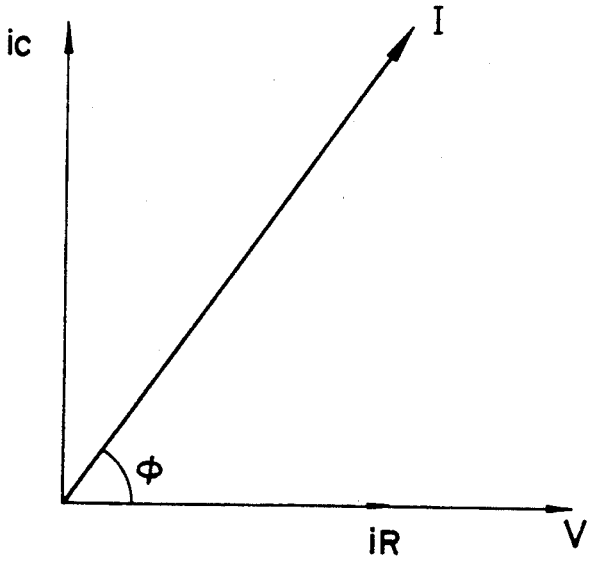
FIG. 4 is a diagram illustrating the current produced when an alternating current voltage is applied to the electric current shown in FIG. 3.

FIG. 3 shows the electric circuit in FIG. 2 as the equivalent current. At the nip position, the carrier layer 26 is interposed between the sleeve 20 and drum 24, and this carrier layer 26 can be approximated to a certain electrostatic capacitance C and a certain electric resistance R, which are connected in parallel. If an alternating current voltage is applied to this circuit, an electric current I as shown in FIG. 4 is obtained. More specifically, the current iR flowing through the resistance R has the same phase as that of the voltage V by the current iC flowing through the capacitance C has a phase advancing by 90° over the phase of the voltage V., Accordingly, the entire current I has a phase advancing by $\phi$ over the phase of the voltage V. Accordingly, the relaxation time ($\tau$) in this circuit can be determined according to the following formula:

$$\tau = \frac{\tan \phi}{\omega}$$

where $\phi$ represents the phase difference between the voltage and current and $\omega$ represents the angular frequency ($=2\pi f$, in which f represent the frequency) of the measurement power source.

According to the present invention, the carrier is selected so that the relaxation time under dynamic conditions, determined by the above-mentioned method, is in the range of from 4.0 to 6.0 milliseconds, especially from 4.5 to 5.7 milliseconds, and this condition is combined with the above-mentioned condition of the current value. Thus, there can be attained not only effects of preventing carrier dragging and improving the image density but also effects of eliminating fogging and letter thinning. Fogging generally means the state where although the optical density of the image area is not substantially high, adhesion of the toner to the background is conspicuous. Letter thinning means the phenomenon that at the development of congregate lines, rear end lacking or front end lacking is caused while the width of respective lines is kept constant.

Figure 5:
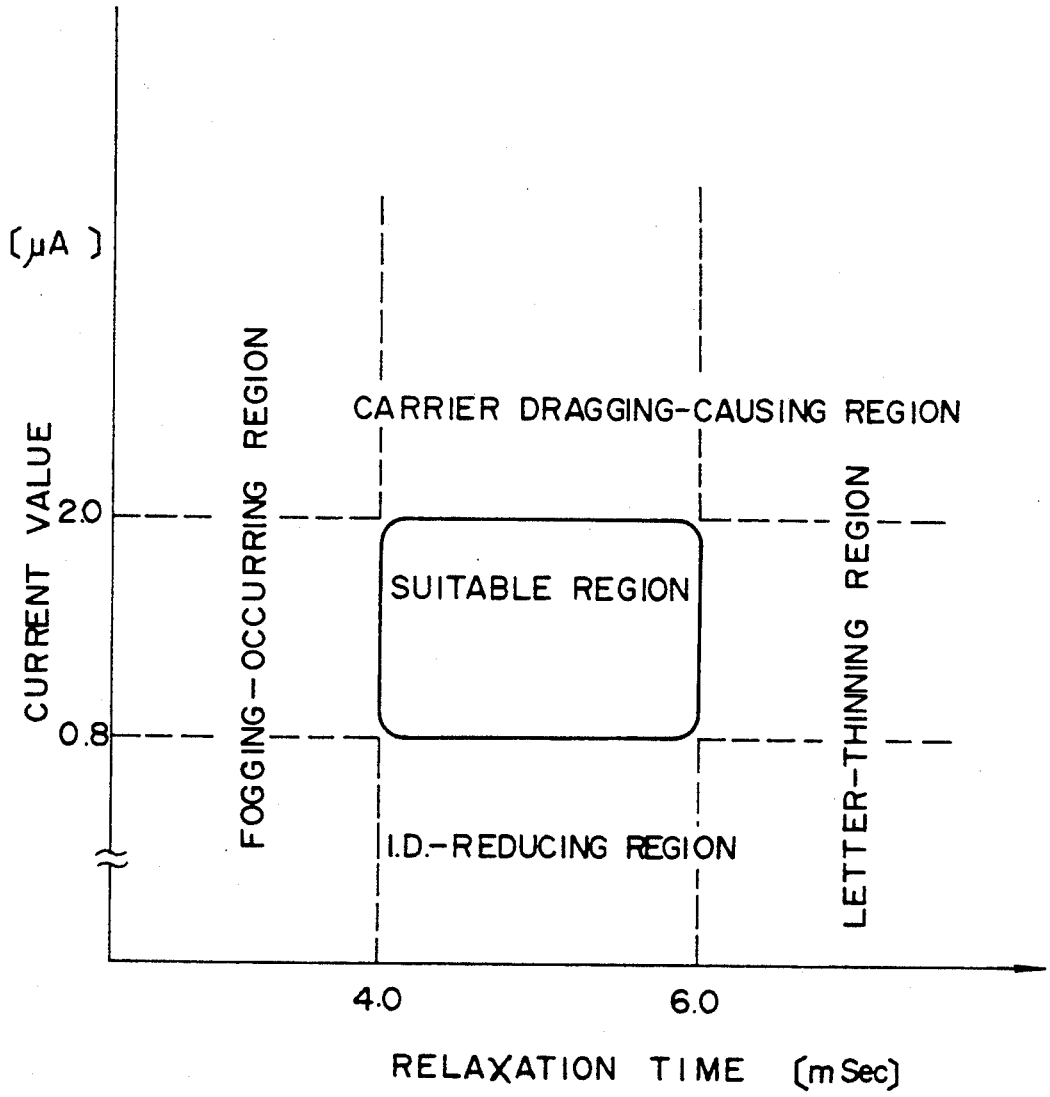
FIG. 5 is a diagram illustrating a range suitable for the carrier in the relation between the current value and the relaxation time.

FIG. 5 shows a suitable range for the magnetic carrier of the present invention. A developer comprising a magnetic carrier included in this range provides a generally well-balanced image quality and does not cause carrier dragging.

In general, if a bias voltage is at least 250 V, especially at least 280 V, this elevation of the bias voltage results in diminishment of the influence of the residual voltage. Namely, even if the residual voltage of the photosensitive material is as high as about 150 V or more, the development can be performed. However, in case of conventional developers, carrier dragging is caused under such a high bias voltage at the development and an image having a high density cannot be obtained. However, when the carrier of the present invention is used, carrier dragging is substantially controlled even if the residual voltage of the photosensitive material is high. As the photosensitive material having a high residual voltage, there can be mentioned a positively chargeable organic photosensitive material.

The adjustment of the magnetic carrier for satisfying the above-mentioned dynamic conditions can be accomplished by controlling the amount coated of the resin. Namely, it is preferred that the amount coated of the resin be such that the carbon amount determined by a carbon analyzer is 1.0 to 1.8% by weight, especially 1.2 to 1.6% by weight. If the amount coated of the resin is thus adjusted based on the carbon amount determined by the carbon analyzer, it is easy to set the amount of the resin coated on the carrier so that the above-mentioned requirements of the current value and relaxation time are satisfied. Since the obtained magnetic carrier is included in the suitable range of the current value and relaxation time, the magnetic carrier can provide a generally excellent image quality.

Preferred embodiments of the developer carrier of the present invention will now be described.

The characteristics of the magnetic carrier of the present invention are comprehensively defined by the current value and relaxation time, and the current value and relaxation time depend on the resistance component and capacitance component of the magnetic carrier. More specifically, increase of the resistance component results in reduction of the current value and increase of the relaxation time. On the other hand, decrease of the resistance component results in increase of the current value and decrease of the relaxation time. Furthermore, increase of the capacitance component results in increase of the relaxation time and decrease of the capacitance component results in decrease of the relaxation time. As the factor having influences on the resistance component and capacitance component of the magnetic carrier, there can be mentioned the particle size, shape, resistivity and dielectric constant of the magnetic carrier.

The magnetic carrier of the present invention comprises a resin coating formed on the surfaces of ferrite particles, and resin-coated ferrite particles having the current value and relaxation time included within the above-mentioned ranges are used. The ferrite particles have influences mainly on the capacitance component and the coating resin has influences mainly on the resistance component and partially on the capacitance component.

Preferably, the ferrite particles have a spherical shape, and it is preferred that the particle size be 20 to 200 μm, especially 50 to 150 μm.

If the carrier having the particle size included within this range is used for an actual copying machine, the relaxation time and current value are kept substantially constant in the dynamic state.

As specific examples of the ferrite particles, sintered ferrite particles composed of at least one member selected from the group consisting of zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$) and lanthanum iron oxide ($LaFeO_3$) are used. Especially, a soft ferrite comprising at least one member, preferably at least two members, selected from the group consisting of Cu, Zn, Mg, Mn and Ni, for example, a copper/zinc/magnesium ferrite, is used.

The current value and relaxation time depend on the kind and amount coated of the resin coated on the surface of the ferrite, and therefore, the amount coated of the resin is determined as the carbon amount measured by a carbon analyzer. In the present invention, in order to satisfy the requirements of the current value and relaxation time, it is preferred that the amount of the resin coated on the carrier, expressed as the carbon amount, be 1.0 to 1.8% by weight, especially 1.2 to 1.6% by weight.

At least one member selected from the group consisting of silicone resins, fluorine resins, acrylic resins, styrene resins, styrene-acrylic resins, olefin resins, ketone resins, phenolic resins, xylene resins and diallyl phthalate resins can be used as the coating resin. Of these resins, a styrene-acrylic resin is especially preferably used because the chargeability and hardness can be easily adjusted.

Preferably, the resin-coated magnetic carrier particles have a spherical shape, and it is preferred that the 50% diameter of the weight average particle size (hereinafter referred to as "$D_{50}$") be in the range of from 50 to 120 μm. If a carrier satisfying this requirement is used, the effect of preventing carrier dragging is further enhanced. Especially, even if the distance $D_{D-S}$ between the developing sleeve and the photosensitive material is shortened to 1 mm or less, carrier dragging can be effectively prevented. Moreover, carrier dragging can be prevented even under a high bias voltage. In order to sufficiently prevent carrier dragging, it is preferred that fractions of fine particle sizes be removed from the carrier. Namely, it is preferred that the content of particles having a size smaller than 250 mesh in the particle size distribution be lower than 8% by weight, especially lower than 5% by weight. If a developer satisfying this requirement is used, carrier dragging can be sufficiently prevented even under a high bias voltage.

As the photosensitive material to be used under a high bias voltage, a positively chargeable organic photosensitive material can be mentioned. The positively chargeable photosensitive material comprises a charge-generating material and a charge-transporting material, which are mixed mainly in one layer, and therefore, an electron and a hole migrate in this one layer and one of them acts as a trap, with the result that the residual voltage tends to increase. This photosensitive material should be used under a bias voltage of at least 250 V or at least 280 V under certain circumstances. The developer carrier of the present invention can form an excellent image even under such a high bias voltage, and carrier dragging is not caused.

A photosensitive material formed by combining a known charge-generating material with a known charge-transporting material can be used as the positively chargeable photosensitive material. An organic photosensitive material previously proposed in Japanese Patent Application No. 62-277158 is especially preferably used as the positively chargeable photosensitive material.

The magnetic carrier having a saturation magnetization of 50 to 70 emu/g, especially 55 to 65 emu/g, is used. This range of the saturation magnetization is lower than the saturation magnetization range of the carrier for the conventional developer. As compared with the conventional carrier, this magnetic carrier promotes softening of the magnetic brush, which results in reduction of the drum stress.

The carrier of the present invention is mixed with a known electroscopic toner to form a two-component type magnetic developer, which is used for developing an electrostatic latent image. The magnetic carrier and toner are mixed at a mixing weight ratio of from 99/1 to 90/10, especially from 98/2 to 95/5.

According to the present invention, the current value and relaxation time of the magnetic carrier under dynamic conditions are controlled within certain ranges, and therefore, a developer comprising the carrier of the present invention provides a generally excellent image quality without reduction of the image density and occurrence of fogging and letter thinning. Moreover, according to the present invention, a coating resin is coated on a carrier core in an amount of 1.0 to 1.8% by weight as the carbon amount measured by a carbon analyzer, and a carrier included within the above-mentioned suitable ranges under dynamic conditions can be provided and an excellent image quality can be provided.

Moreover, since carrier dragging can be effectively prevented, the carrier of the present invention can be advantageously used as a developer carrier for a positively chargeable photosensitive material frequently used in these days.

The present invention will now be described in detail with reference to the following examples and comparative examples that by no means limit the scope of the invention.

EXAMPLES 1 THROUGH 4 AND COMPARATIVE EXAMPLES 1 THROUGH 5

In a remodelled machine of electrophotographic copying machine DC-152Z supplied by Mita Kogyo, by using developers (Examples 1 through 4) comprising a ferrite type magnetic carrier having properties shown in Table 1 under static and dynamic conditions and a toner formed by dispersing carbon black in a styrene-acrylic binder resin, the image density (ID), letter thinning, carrier dragging and fogging were checked and evaluated.

Figure 6:
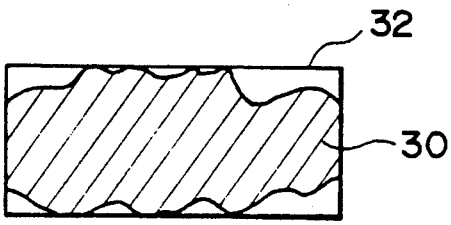
FIG. 6 is a diagram comparing lines of an original with lines of a copy.

The developing conditions were as shown in Table 1. The carrier and toner were mixed at a weight ratio of from 95/5 to 99/1 to form a developer. The letter thinning ratio was determined in the following manner. Namely, an original was copied, and the obtained copy was copied again. As shown in FIG. 6, the area ratio of lines 30 of the obtained copy was compared with the area ratio of lines of the original, and the letter thinning ratio (%) was calculated according to the following formula:

$$\text{Letter thinning ratio} = \frac{(\text{line area of original}) - (\text{line area of copy})}{\text{line area of original}}$$

TABLE 1

| | Example 1 | Example 2 | Example 3 | Example 4 | Comparative Example 1 | Comparative Example 2 |
|---|---|---|---|---|---|---|
| Component | | | | | | |
| Carrier | | | | | | |
| relaxation time (milliseconds) | 4.5 | 5.8 | 4.2 | 4.8 | 3.8 | 7.4 |
| current value (μA) | 1.3 | 1.2 | 1.6 | 1.1 | 1.6 | 1.0 |
| diameter $D_{50}$ (μm) | 98 | 103 | 103 | 120 | 99 | 105 |
| content (% by weight) of particles having size smaller than 250 mesh | 3 | 4 | 4 | 5 | 2 | 1 |
| carbon amount (% by weight) of styrene-acrylic resin | 1.2 | 1.6 | 1.6 | 1.3 | 0.9 | 2.0 |
| Toner | | | | | | |
| colorant | carbon black | carbon black | carbon black | carbon black | carbon black | carbon black |
| particle size (μm) | 12 | 12 | 12 | 10 | 12 | 12 |
| Developer | | | | | | |
| density (g/cc) | 1.90 | 1.89 | 1.98 | 1.83 | 1.91 | 1.88 |
| initial charge quantity (μc) | −14.0 | −15.1 | −16.2 | −14.1 | −14.0 | −18.0 |
| Developing Conditions | | | | | | |
| photosensitive material | positively chargeable | positively chargeable | positively chargeable | Se | positively chargeable | positively chargeable |
| developing voltage difference (V) | 460 | 460 | 440 | 580 | 460 | 460 |
| bias voltage (V) | 290 | 290 | 300 | 200 | 290 | 290 |
| $D_{D-S}$ distance (mm) | 0.8 | 0.8 | 0.7 | 1.1 | 0.8 | 0.8 |
| brush cutting length (mm) | 0.7 | 0.7 | 0.6 | 1.0 | 0.7 | 0.7 |
| Results | | | | | | |
| carrier dragging | not caused | not caused | not caused | not caused | not caused | not caused |
| fogging | 0.003 | 0.001 | 0.002 | 0.003 | 0.012 | 0.001 |
| image density (ID) | 1.43 | 1.42 | 1.39 | 1.40 | 1.44 | 1.28 |
| letter thinning ratio (%) | −5 | +5 | −3 | +3 | −11 | +30 |

| | Comparative Example 3 | Comparative Example 4 | Comparative Example 5 |
|---|---|---|---|
| Component | | | |
| Carrier | | | |

TABLE 1-continued

| | | | |
|---|---|---|---|
| relaxation time (milliseconds) | 5.9 | 4.3 | 7.0 |
| current value (μA) | 0.7 | 2.1 | 2.1 |
| diameter $D_{50}$ (μm) | 100 | 80 | 160 |
| content (% by weight) of particles having size smaller than 250 mesh | 2 | 5 | 8 |
| carbon amount (% by weight) of styrene-acrylic resin | 2.2 | 1.0 | 1.0 |
| Toner | | | |
| colorant | carbon black | carbon black | carbon black |
| particle size (μm) | 12 | 12 | 12 |
| Developer | | | |
| density (g/cc) | 1.89 | 1.99 | 1.82 |
| initial charge quantity (μc) | −19.2 | −15.1 | −15.3 |
| Developing Conditions | | | |
| photosensitive material | positively chargeable | positively chargeable | positively chargeable |
| developing voltage difference (V) | 460 | 460 | 460 |
| bias voltage (V) | 290 | 290 | 290 |
| $D_{D-S}$ distance (mm) | 0.8 | 0.8 | 0.8 |
| brush cutting length (mm) | 0.7 | 0.7 | 0.7 |
| Results | | | |
| carrier dragging | not caused | caused | caused |
| fogging | 0.002 | 0.005 | 0.001 |
| image density (ID) | 1.18 | 1.43 | 1.40 |
| letter thinning ratio (%) | +33 | −8 | +25 |

Note
1) If the value of fogging is not larger than 0.003, the fogging-preventing effect is satisfactory.
2) The value of ID is larger than 1.25, the image density is satisfactory.
3) If the letter thinning ratio is within ±10%, the letter thinning-preventing effect is satisfactory.

Note

1) If the value of fogging is not larger than 0.003, the fogging-preventing effect is satisfactory.

2) The value of ID is larger than 1.25, the image density is satisfactory.

3) If the letter thinning ratio is within ±10%, the letter thinning-preventing effect is satisfactory.

We claim:

1. A magnetic carrier having a surface coated with a resin, wherein the resin coating of the surface is carried out so that the amount of carbon measured by a carbon analyzer is 1.0 to 1.8% by weight based on the entire amount of the carrier, a carrier current value, defined as a current value measured when a direct current at the voltage is 200 V impressed under dynamic conditions, is 0.8 to 2.0 μA, and when an alternating voltage is impressed, a relaxation time ($\tau$), defined by the following formula:

$$\tau = \frac{\tan \phi_1}{\omega}$$

wherein $\phi$ is a phase difference between the measured current and the measured voltage, and $\omega$ is an angular frequency of the impressed alternating voltage, is in the range of 4.0 to 6.0 milliseconds.

2. A magnetic carrier according to claim 1, wherein the resin coating is carried out by using a styrene-acrylic resin.

3. A developer carrier as set forth in claim 1 or 2, wherein the carrier material is composed of spherical carrier ferrite particles.

4. A developer carrier as set forth in claim 3, wherein the ferrite particles have a particle size of from 20 to 200 μm.

* * * * *